US009322228B2

(12) United States Patent
Davila et al.

(10) Patent No.: US 9,322,228 B2
(45) Date of Patent: Apr. 26, 2016

(54) CENTRALIZER CONNECTOR

(75) Inventors: Juan Francisco Davila, Cypress, TX (US); Colin Joseph Lewis, Houston, TX (US); Michael Everett Leman, Humble, TX (US)

(73) Assignee: TESCO CORPORATION, Houston, TX (US)

( * ) Notice: Subject to any disclaimer, the term of this patent is extended or adjusted under 35 U.S.C. 154(b) by 841 days.

(21) Appl. No.: 13/485,659

(22) Filed: May 31, 2012

(65) Prior Publication Data

US 2013/0319686 A1 Dec. 5, 2013

(51) Int. Cl.
*E21B 17/10* (2006.01)
*E21B 17/12* (2006.01)

(52) U.S. Cl.
CPC ..... *E21B 17/1078* (2013.01); *E21B 17/12* (2013.01)

(58) Field of Classification Search
CPC ..... E21B 17/1078; E21B 17/1028; E21B 17/1057; E21B 17/12; E21B 23/02; E21B 33/129
USPC ..... 166/216, 217, 241.1–241.7; 175/325.1, 175/325.5
See application file for complete search history.

(56) References Cited

U.S. PATENT DOCUMENTS

| | | | | | |
|---|---|---|---|---|---|
| 327,793 | A * | 10/1885 | Hall | 285/92 |
| 2,858,099 | A * | 10/1958 | Althouse, Jr. et al. | 251/347 |
| 2,872,226 | A * | 2/1959 | Wright et al. | 403/366 |
| 3,253,332 | A * | 5/1966 | Howlett et al. | 29/506 |
| 3,343,808 | A * | 9/1967 | Howlett | 254/133 R |
| 3,482,889 | A * | 12/1969 | Cochran | 175/325.5 |
| 4,000,549 | A * | 1/1977 | Brumley et al. | 175/325.5 |
| 4,105,262 | A * | 8/1978 | Richey | 175/325.2 |
| 4,378,135 | A * | 3/1983 | Enen et al. | 175/325.5 |
| 4,600,063 | A * | 7/1986 | Beasley | 175/325.5 |
| 4,630,690 | A * | 12/1986 | Beasley et al. | 175/57 |
| 5,131,468 | A * | 7/1992 | Lane et al. | 166/120 |
| 5,309,621 | A * | 5/1994 | O'Donnell et al. | 29/447 |
| 6,513,223 | B1 * | 2/2003 | Angman et al. | 29/447 |
| 6,585,052 | B2 * | 7/2003 | Angman et al. | 166/380 |
| 7,104,318 | B2 * | 9/2006 | Hendrie | 166/241.1 |
| 7,624,798 | B2 * | 12/2009 | Presslie et al. | 166/241.7 |
| 8,225,864 | B2 * | 7/2012 | Angman | 166/241.6 |
| 8,464,786 | B2 * | 6/2013 | Langlais et al. | 166/139 |
| 8,689,864 | B2 * | 4/2014 | Reid | 166/242.7 |
| 2002/0170709 | A1 * | 11/2002 | Yokley | 166/75.14 |
| 2008/0093079 | A1 * | 4/2008 | Bryant et al. | 166/313 |
| 2013/0160993 | A1 * | 6/2013 | Davila et al. | 166/241.6 |

OTHER PUBLICATIONS

U.S. Appl. No. 13/333,809, filed Dec. 21, 2011, Juan Francisco Davila.

* cited by examiner

*Primary Examiner* — Kenneth L Thompson
*Assistant Examiner* — Michael Wills, III
(74) *Attorney, Agent, or Firm* — Fletcher Yoder, PC

(57) ABSTRACT

Embodiments of the present disclosure are directed toward a wedge segment. In certain embodiment, the wedge segment includes an arcuate body having a tapered profile sized to engage with a tubular element, a first surface of the arcuate body comprising a first surface treatment configured to grip an outer surface of the tubular element, and a second surface comprising a second surface treatment configured to grip an inner surface of an annular member disposed about the tubular element.

17 Claims, 6 Drawing Sheets

CENTRALIZER CONNECTOR

FIELD OF DISCLOSURE

The present disclosure relates generally to the field of well drilling operations. More specifically, embodiments of the present disclosure relate to the use of centralizers with casing or tubing in a down-hole environment and the attachment of such centralizers or other structures to the casing or tubing.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

Liner may also be employed in some drilling operations. Liner may be defined as a string of pipe or tubular that is used to case open hole below existing casing. Casing is generally considered to extend all the way back to a wellhead assembly at the surface. In contrast, a liner merely extends a certain distance (e.g., 30 meters) into the previously installed casing or parent casing string. However, a tieback string of casing may be installed that extends from the wellhead downward into engagement with previously installed liner. The liner is typically secured to the parent casing string by a liner hanger that is coupled to the liner and engages with the interior of the upper casing or liner. The liner hanger may include a slip device (e.g., a device with teeth or other gripping features) that engages the interior of the upper casing string to hold the liner in place. It should be noted that, in some operations, a liner may extend from a previously installed liner or parent liner. Again, the distinction between casing and liner is that casing generally extends all the way to the wellhead and liner only extends to a parent casing or liner. Accordingly, the terms "casing" and "liner" may be used interchangeably in the present disclosure. Indeed, liner is essentially made up of similar components (e.g., strings of tubular structures) as casing. Further, as with casing, a liner is typically cemented into the well.

Thus, establishing a down-hole operation, such as may be involved in conventional oil and gas operations, may involve deploying and operating a variety of tubular components (e.g., casing, liner, drill pipe, and so forth) down a tubular wellbore, while the wellbore is being formed or after the wellbore is formed. In certain instances, the tubular elements may be fitted with a component that acts to centralize the tubular elements within the bore, e.g., a centralizer. For example, during a casing drilling operation, a series of centralizers may be fitted to the casing during the drilling operation to keep the casing centered within the bore. For example, the centralizers may be fitted at the joints where casing segments are joined (such as every 30 feet) or at other periodic distances to insure that the casing remains centered in the bore.

BRIEF DESCRIPTION

In accordance with one embodiment, a wedge segment includes an arcuate body having a tapered profile sized to engage with a tubular element, a first surface of the arcuate body comprising a first surface treatment configured to grip an outer surface of the tubular element, and a second surface of the arcuate body comprising a second surface treatment configured to grip an inner surface of an annular member disposed about the tubular element.

In accordance with a second embodiment, an assembly includes a casing or liner string, a centralizer disposed around a circumference of the casing or liner string, and a first wedge segment positioned between an inner surface of a first end of the centralizer and an outer surface of the casing or liner string.

In accordance with a third embodiment, a method for coupling a centralizer to a tubular member includes disposing the centralizer about the tubular member, creating a first frictional engagement between a first wedge segment and the tubular member, and creating a second frictional engagement between the first wedge segment and the centralizer.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure relates generally to the attachment of a centralizer (or other structure) to a down-hole component, such as a casing, liner, or drill pipe. Embodiments of the present disclosure are directed to providing and using one or more wedge segments for attachment of a centralizer to a tubular component. In one implementation, an arcuate (i.e., curved) or annular (i.e., ring-like) wedge segment for attaching a centralizer has a surface texture or finish on one surface (e.g., an outer surface) to mate with an inner surface on an end of the centralizer. The wedge segment has a second surface (e.g., an inner surface) with a surface texture or finish for gripping a surface (e.g., an outer surface) of the tubular element (e.g., casing) to which the centralizer is being attached. For example, the surface textures or finishes on the first and/or second surfaces of the wedge segment may be grooves, teeth, ridges, or other surface treatments configured to create frictional resistance. In such an implementation, one or more wedge segments may be positioned at each end of the centralizer to be attached, and the wedge segments may be forced inward (e.g., towards a center of the centralizer) between the centralizer and the underlying tubular element. The wedge shape of the wedge segments causes both the centralizer and underlying tubular element to engage (e.g., frictionally) with the wedge segments so as to attach the centralizer to the underlying tubular element.

Figure 1:
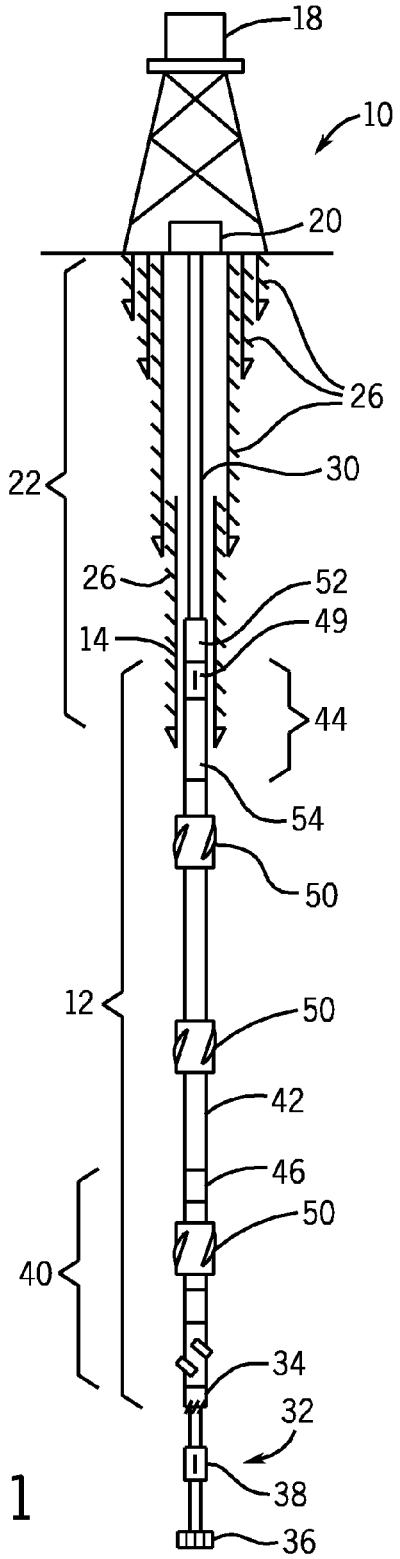
FIG. 1 is a schematic representation of a well being drilled in accordance with aspects of the present disclosure.

With the foregoing in mind, and turning to the figures, FIG. 1 is a schematic representation of a well 10 that is being drilled using a casing-while-drilling technique, wherein a liner string 12 is about to be hung within a previously installed liner 14 that was cemented into the well 10. In other embodiments, different drilling techniques may be employed. The well 10 includes a derrick 18, wellhead equipment 20, and several levels of casing 22 (e.g., conductor pipe, surface pipe, intermediate string, and so forth), which includes the previously installed liner 14, which may be casing in some embodiments. The casing 22 and the liner 14 have been cemented into the well 10 with cement 26. Further, as illustrated in FIG. 1, the liner string 12 is in the process of being hung from the previously installed liner 14, which may be referred to as the parent liner 14.

While other embodiments may utilize different drilling techniques, as indicated above, the well 10 is being drilled using a casing-while-drilling technique. Specifically, the liner string 12 is being run as part of the drilling process. In the illustrated embodiment, a drill pipe 30 is coupled with the liner string 12 and a drilling BHA 32. The drilling BHA 32 is also coupled with an upper portion of the liner string 12 and extends through the liner string 12 such that certain features of the drilling BHA 32 extend out of the bottom of the liner string 12. Indeed, an upper portion of the drilling BHA 32 is disposed within the inside diameter of the liner string 12, while a lower portion of the drilling BHA 32 extends out of a liner shoe 34 at the bottom of the liner string 12. Specifically, in the illustrated embodiment, a drill bit 36 and an under reamer 38 of the drilling BHA 32 extend out from the liner string 12. Thus, the drilling BHA 32 is positioned to initiate and guide the drilling process.

The liner string 12 includes a shoe track 40, a string of tubing 42, and a liner top assembly 44. The shoe track 40 defines the bottom of the liner string 12 and includes the liner shoe 34 to facilitate guiding the liner string 12 through the wellbore. In the illustrated embodiment, the shoe track 40 also includes an indicator landing sub 46 to facilitate proper engagement with the drilling BHA 32, and various other features, such as a pump down displacement plug (PDDP). The string of tubing 42 is essentially the main body of the liner string 12 that connects the shoe track 40 with the liner top assembly 44. The liner top assembly 44, which defines the top of the liner string 12, includes a liner hanger 49 that is capable of being activated and/or deactivated by a liner hanger control tool 52. The liner top assembly 44 may also include a liner drill lock section 54, which includes a liner drill lock that facilitates engagement/disengagement of the drill string 30 from the liner string 12. The liner drill lock may be actuated by external or internal components affixed to or part of a body of the liner hanger 49.

Once a desired depth is reached, the liner string 12 may be hung or set down to facilitate detachment of the drilling BHA 32. As illustrated in FIG. 1, the liner string 12 may be hung from the parent liner 14, and the drilling BHA 32 may be detached from the liner string 12 and pulled out of the well 10 with the drill string 30 and an inner string (not shown). In order to hang the liner string 12 from the parent liner 14, the hanger 49 may be activated with the liner hanger control tool 52. In some embodiments, the hanger 49 is not utilized and the liner string 12 is set on bottom.

The casing and liner strings (e.g., the casing 22, the parent liner 14, and the liner string 12) are run into the well 10 using a running tool. As used herein, the terms "casing" and "liner" may be used interchangeably in the present disclosure. As will be appreciated from this discussion, a wide array of tubular elements (e.g., casing, liner, drill pipe, and so forth) may be positioned within the wellbore. For example, in the above described implementation of casing-while-drilling, casing or liner string 12 may be positioned in the well bore as part of the drilling or deployment operation. For instance, in one type of implementation, the casing may consist of 30 foot segments of a suitable diameter (e.g., 13⅜ inches) that are joined as the casing is deployed down the wellbore. As will be appreciated, in other implementations, length of the casing segments and/or the diameter of the casing may be any suitable length or diameter.

Figure 2:
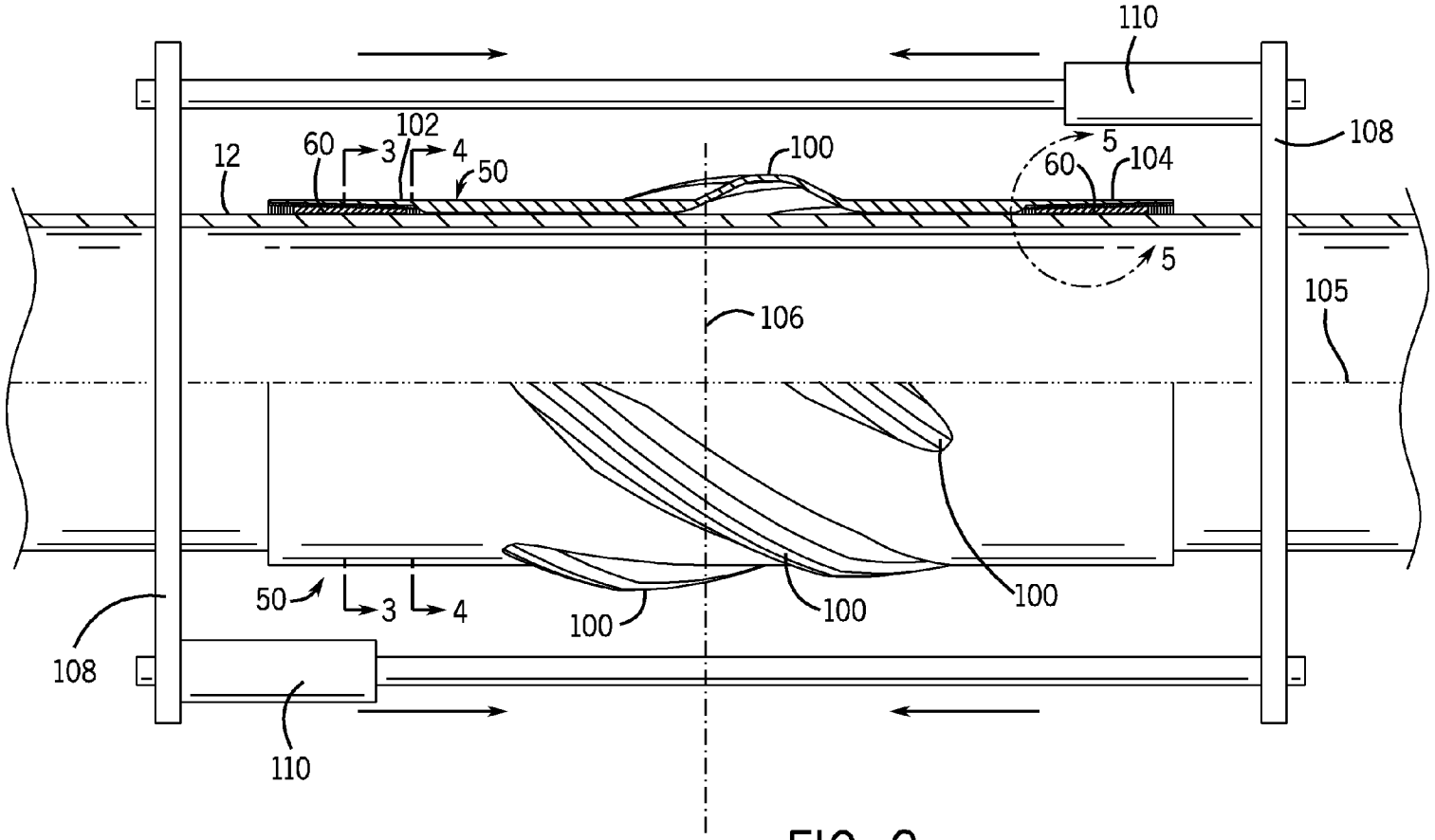
FIG. 2 is a partial cut-away view of a centralizer attached to a casing or liner using wedge segments, in accordance with aspects of the present disclosure.

As discussed herein, some of the various tubular elements, such as the casing, may have one or more centralizing elements (i.e., centralizers 50) attached using techniques in accordance with the present disclosure. The attached centralizing elements keep the tubular element centered within the wellbore when deployed and operated (e.g., rotated). Turning to FIG. 2, one example of a centralizer 50 disposed about a casing or liner string 12 is depicted in a partial cut-away view. In this example, the centralizer 50 has raised features 100 disposed circumferentially about the centralizer 50. During operation, these raised features 100 of the centralizer 50 act to keep the casing or liner string 12 centered within the wellbore. In one implementation, the walls of the centralizer 50 are ½ inch thick, though in other implementations the walls of the centralizer 50 may be any suitable thickness. In addition, the centralizer 50 includes a first end 102 and a second end 104 that are each configured to accommodate one or more wedge segments 60. That is, the first end and second end 102 and 104 each expand relative to other portions of the centralizer 50 to define pockets that function to receive the wedge segments 60. In one embodiment, inner surfaces of the first and second ends 102 and 104 may have surface treatments (e.g., finishes or textures) configured to enable a frictional engagement with the wedge segments 60. Similarly, inner and/or outer surfaces of the wedge segments 60 may includes surface treatments configured to enable frictional engagements with the first and second ends 102 and 104 of the centralizer 50 and the casing or liner string 12. Additionally, as will be discussed below, the first and second ends 102 and 104 may be configured to engage a single circular wedge.

As mentioned above, the wedge segments 60 are initially positioned such that they are aligned with a lengthwise axis 105 of the centralizer 50 and generally outside of the first and second ends 102 and 104 of the centralizer 50. Subsequently, the wedge segments 60 are forced towards a central radial axis 106 of the centralizer 50 and wedged between the first and second ends 102 and 104 and the casing or liner string 12. For example, as discussed below, each end 102 and 104 of the centralizer 50 may accommodate 1, 2, 3, 4, 5, 6, or more wedge segments 60. Specifically, once the wedge segments 60 are positioned at the respective ends 102 or 104 of the centralizer 50, the wedge segments 60 are forced inward by annular plates 108 disposed about the casing or liner 12 on opposite ends of the centralizer 50. More specifically, the annular plates 108 may be coupled to hydraulic rams 110, and the hydraulic rams 110 may contract or shorten to translate the annular plates 108 toward one another. In this manner, the annular plates 108 may drive the wedge segments 60 between the centralizer 50 and the casing or liner 12. As the wedge segments 60 are forced or wedged between the centralizer 50 and the casing or liner 12, the inner and outer surfaces of the wedge segments 60 may frictionally engage with the casing or liner 12 and the centralizer 50, respectively, thereby securing the centralizer 50 to the casing or liner 12.

Figure 3:
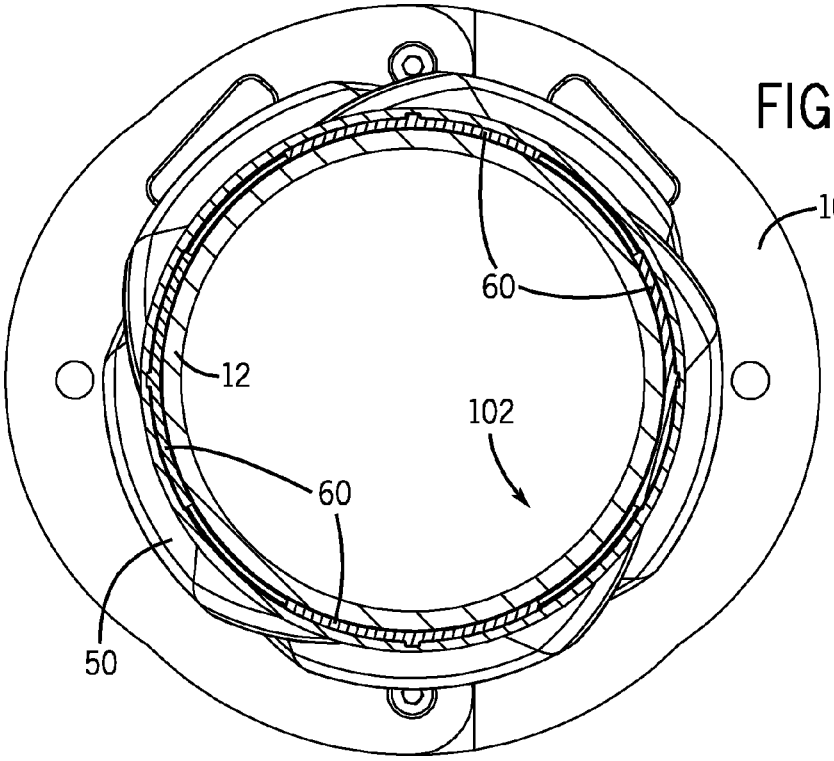
FIG. 3 is an axial cross-sectional view of a centralizer attached to a casing or liner using multiple wedge segments, in accordance with aspects of the present disclosure.
Figure 4:
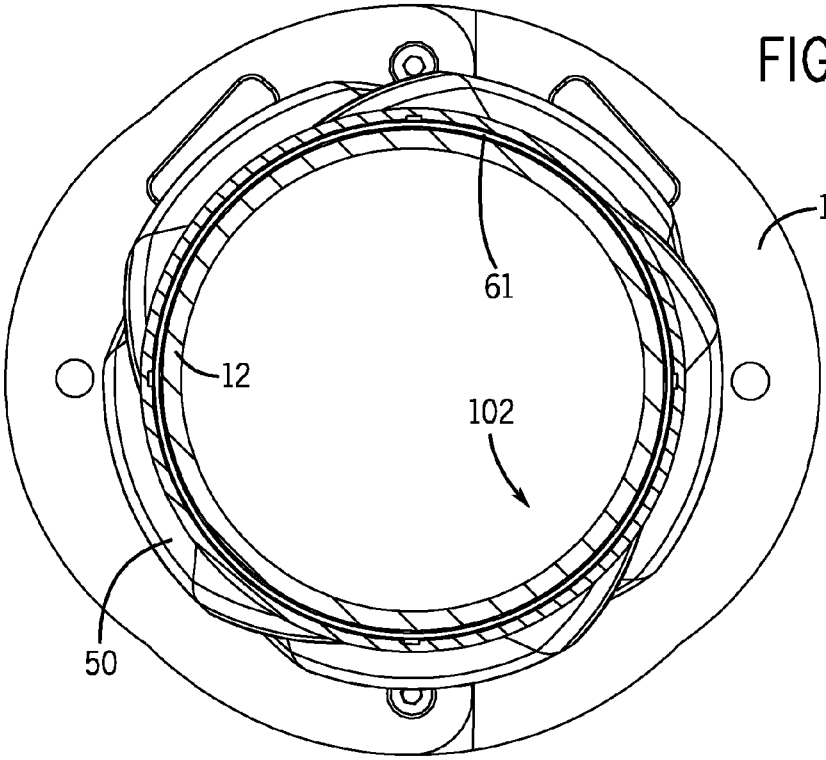
FIG. 4 is an axial cross-sectional view of a centralizer attached to a casing or liner using a single circular wedge, in accordance with aspects of the present disclosure.

FIGS. 3 and 4 are axial cross-sectional views of the first end 102 of the centralizer 50 coupled to the casing or liner 12. Specifically, FIG. 3 illustrates four wedge segments 60 coupling the first end 102 of the centralizer 50 to the casing or liner 12, and FIG. 4 illustrates a single circular wedge 61 coupling the first end 102 of the centralizer 50 to the casing or liner 12. It should be noted that while FIGS. 3 and 4 each only illustrate the first end 102 of the centralizer 50, the second end 104 may be coupled to the casing or liner 12 in a similar manner. For example, in the embodiment shown in FIG. 3, four wedge segments 60 may also be used to couple the second end 104 (not shown) of the centralizer 50 to the casing or liner 12. However, in other embodiments, different numbers of wedge segments 60 may be used to couple the first and second ends 102 and 104 of the centralizer 50 to the casing or liner 12. For example, in the embodiment illustrated by FIG. 4, a plurality of wedge segments 60 may be utilized to couple the second end 104 with the casing or liner 12 while the first end 102 is coupled via the single circular wedge 61 (e.g., an annular or ring-like wedge). In yet another embodiment, one wedge segment 60 may also be used to couple the second end 104 (not shown) of the centralizer 50 to the casing or liner 12 in FIG. 4. In other embodiments, the first and second ends 102 and 104 of the centralizer 50 may each use 2, 3, 5, 6, or more wedge segments 60 to couple the centralizer 50 to the casing or liner 12. Furthermore, in embodiments using multiple wedge segments 60, the wedge segments 60 may be equidistantly spaced about the casing or liner 12. In this manner, the securement of the centralizer 50 to the casing or liner 12 may be improved through approximately even distribution of frictional forces about the wedge segments 60, the casing or liner 12, and the centralizer 50.

Figure 5:
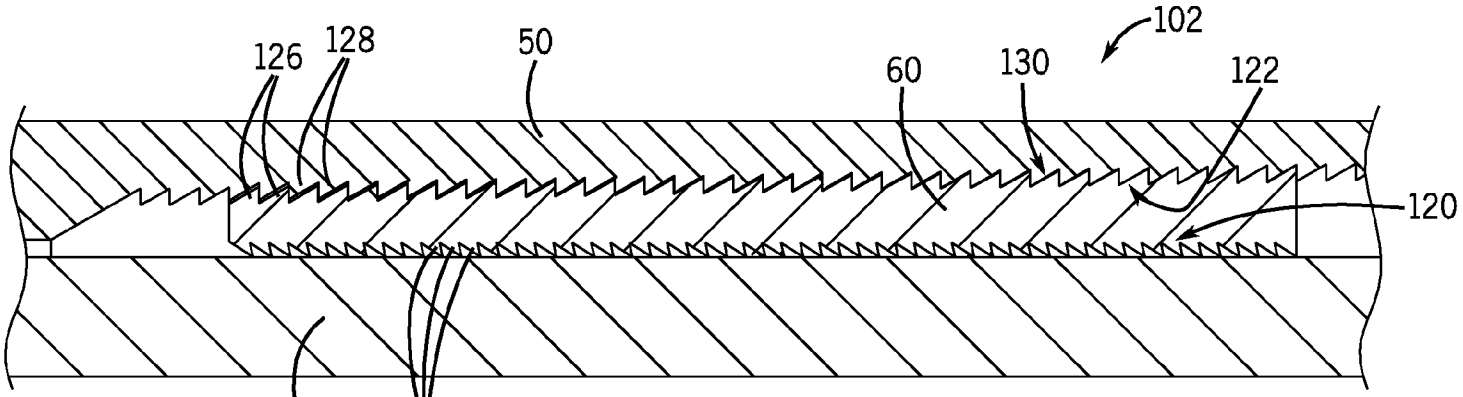
FIG. 5 is a partial cut-away view of an embodiment of a wedge segment and a centralizer end region, in accordance with aspects of the present disclosure.
Figure 6:
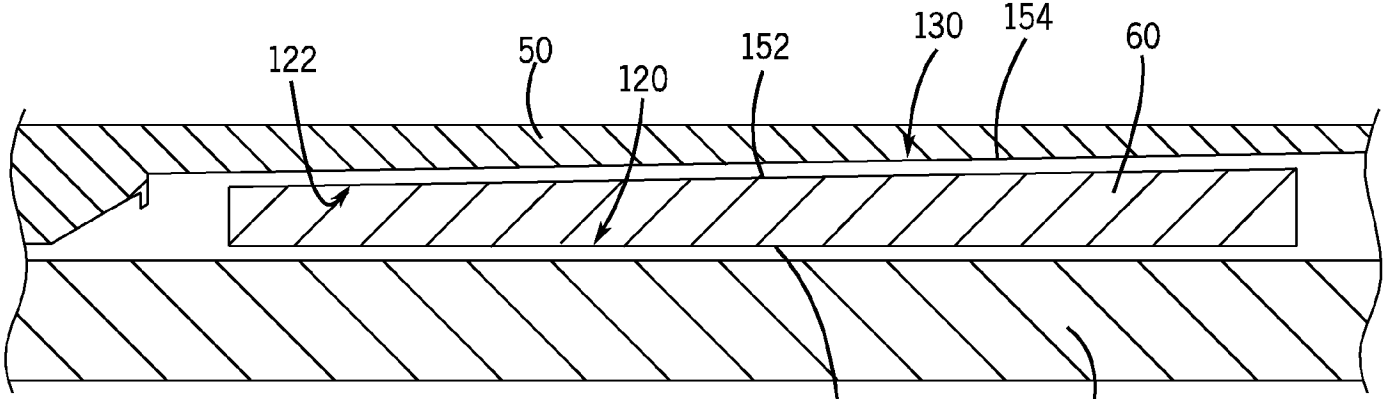
FIG. 6 is a partial cut-away view of an embodiment of a wedge segment and a centralizer end region, in accordance with aspects of the present disclosure.

FIGS. 5 and 6 are partial cut-away views of embodiments of the wedge segment 60 and the first end 102 of the centralizer 50. For example, in FIG. 5, the wedge segment 60 has a tapered profile and includes an inner surface 120 and an outer surface 122. In other words, the inner surface 120 and the outer surface 122 of the wedge segment 60 are angled relative to one another to create the tapered profile or wedge shape of the wedge segment 60. For example, the inner and outer surfaces 120 and 122 may be disposed at an angle of approximately 1 to 6, 2 to 5, or 3 to 4 degrees relative to one another. Additionally, the wedge segment 60 may be approximately 6 inches long, although in other implementations the wedge segment 60 may be any other suitable length. It should be noted that FIGS. 5 and 6 may also be representative of partial cut-away view of embodiments of the circular wedge 61 and the first end 102 of the centralizer 50.

As shown in the embodiment illustrated by FIG. 5, the inner surface 120 of the wedge segment 60 includes a series of teeth 124 that facilitate gripping of the casing or liner 12 when the wedge segment 60 is used in conjunction with the centralizer 50. Specifically, due to the wedge shape of the wedge segment 60 (e.g., the tapered profile of the wedge segment 60 described above), a downward force is applied to the casing or liner 12 as the wedge segment 60 is forced between the centralizer 50 and the casing or liner 12 by the annular plate 108. As a result, the teeth 124 of the inner surface 120 of the wedge segment 60 bite into the casing or liner 12, thereby securing the centralizer 50 in place. Moreover, in the depicted implementation, the teeth 124 are angled so as to facilitate movement of the wedge segment 60 inward toward the central radial axis 106 of centralizer 50, but resist movement of the wedge segment 60 outward. Once in place, the wedge segment 60 grips the underlying casing or liner string 12 and remains stationary. In certain embodiments, the teeth 124 on the inner surface 120 may be carburized. As will be appreciated, carburization of the teeth 124 may harden the teeth 124, block puncture of the casing or liner 12 by the teeth 124, and/or reduce corrosion between the wedge segment 60 and the casing or liner 12.

Furthermore, the outer surface 122 of the wedge segment 60 also includes teeth 126. The teeth 126 formed on the outer surface 122 engage with similar teeth 128 formed on an inner surface 130 of the centralizer 50. As shown, the teeth 126 formed in the outer surface 122 are angled so as to facilitate movement of the wedge segment 60 inward towards the central radial axis 106 of the centralizer 50, but resist movement of the wedge segment 60 outward. More specifically, the teeth 128 formed in the centralizer 60 are angled outward, and therefore engage with the teeth 126 formed in the outer surface 122 of the wedge segment 60 to block or resist movement of the wedge segment 60 outwards. For example, the teeth 126 of the wedge segment 60 and the teeth 128 of the centralizer 50 may have similar but opposite angles to facilitate engagement of the teeth 126 and 128 to block movement of wedge segment 60 in an outward direction. In other embodiments, one or both sets of teeth 126 and 128 may be excluded.

FIG. 6 illustrates an embodiment of the wedge segment 60 where the inner and outer surfaces 120 and 122 of the wedge segment 60 have surface treatments other than teeth. Specifically, FIG. 6 illustrates a first surface treatment 150 on the inner surface 120 and a second surface treatment 152 on the outer surface 122. For example, the first and second surface treatments 150 and 152 may include a roughness or coarse surface formed with grinding, blasting, etching, glazing, or other process. Additionally, the first and second surface treatments 150 and 152 may include the application of additional material to the inner and outer surfaces 120 and 122 of the wedge segment 60, such as textured polyurethane. As will be appreciated, the surface treatments 150 and 152 are configured to increase the roughness (e.g., the coefficient of friction) of the inner and outer surfaces 120 and 122, respectively, of the wedge segment 60. In other words, the surface treatments 150 and 152 may increase the frictional forces created between the wedge segment 60 and the casing or liner 12 and the centralizer 60 when the wedge segment 60 is forced between the casing or liner 12 and the centralizer 60. In this manner, the frictional forces between the wedge segment 60 and the casing or liner 12 and the centralizer 50 may enable the securement of the centralizer 50 to the casing or liner 12. Furthermore, in certain embodiments, the inner surface 130 of the centralizer 50 may also have a surface treatment 154, which may be similar to the surface treatments 150 and 152.

As similarly discussed above, in the illustrated embodiment, the wedge segment 60 may have a tapered configuration. In other words, the inner and outer surfaces 120 and 122 may be disposed at an angle relative to one another, thereby giving the wedge segment 60 a wedge shape. Consequently, as the wedge segment 60 progresses toward the radial axis 106 during coupling of the centralizer 50 to the casing or liner 12, a radially inward force is increasingly applied to the casing or liner 12 as the wedge segment 60 is forced between the centralizer 50 and the casing or liner 12 by the annular plate 108. As the radially inward force is applied to the casing or liner 12, the surface treatment 150 of the inner surface 120 of the wedge segment 60 increasingly engages the casing or liner 12. As a result, frictional forces are created between the wedge segment 60 and the casing or liner 12, thereby blocking or resisting movement of the wedge segment 60 outward and securing the centralizer 50 to the casing or liner 12.

Figure 7:
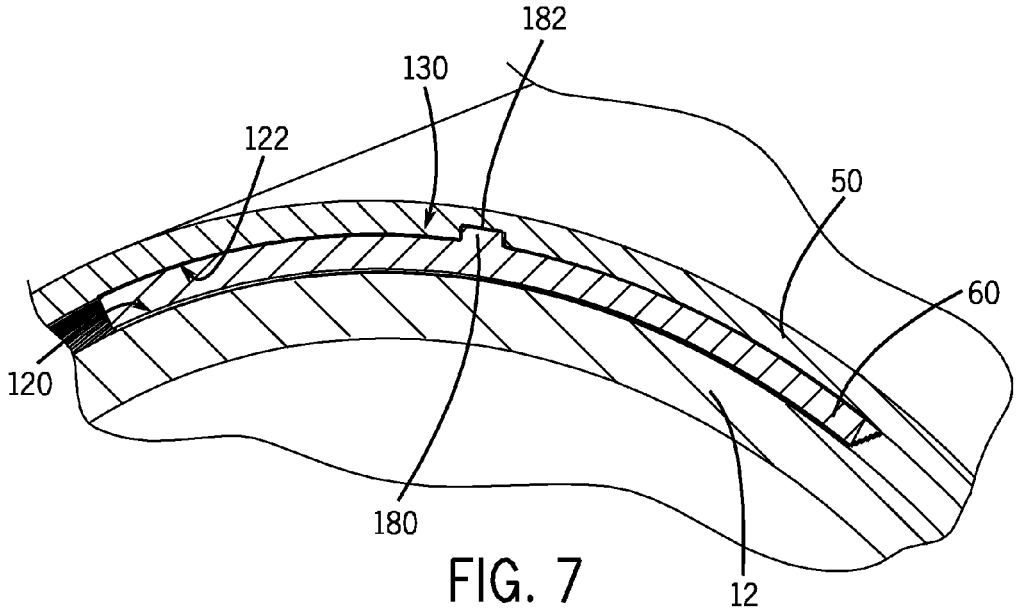
FIG. 7 is a partial perspective view of an embodiment of a wedge segment and a centralizer end region, in accordance with aspects of the present disclosure.

FIG. 7 is a partial perspective view of an embodiment of the wedge segment 60 disposed between the centralizer 50 and the casing or liner 12. In the illustrated embodiment, a key 180 is formed in the outer surface 122 of the wedge segment 60. As shown, the key 180 engages with a matching keyhole 182 formed in the inner surface 130 of the centralizer 50. Engagement of the key 180 and the keyhole 182 may block rotation of the centralizer 50 about the casing or liner 12 when the wedge segment 60 is positioned between the centralizer 50 and the casing or liner 12. In other words, the key 180 and the keyhole 182 engage to secure the centralizer 50 to the casing or liner 12 in a fixed location.

Figure 8:
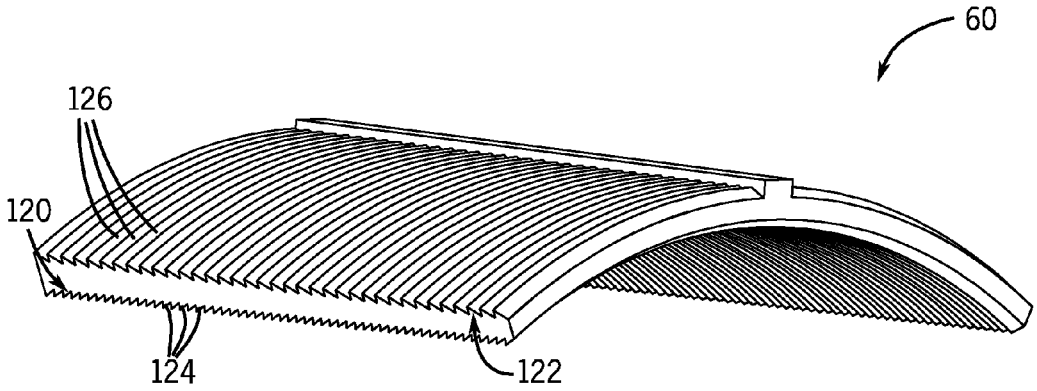
FIG. 8 is a perspective view of a wedge segment, in accordance with aspects of the present disclosure.

FIG. 8 is a perspective view of an embodiment of the wedge segment 60. As mentioned above, the wedge segment 60 may be an arcuate plate configured to be disposed between the casing or liner 12 and the centralizer 50 to secure the centralizer 60 to the casing or liner 12. However, in other embodiments, the circular wedge 61 including an annular or ring-like structure may be utilized. In the illustrated embodiment, the inner surface 120 of the wedge segment 60 includes the teeth 124, and the outer surface 122 of the wedge segment 60 includes the teeth 126. Additionally, the wedge segment 60 includes the key 180 which may engage with the corresponding keyhole 182 formed in the inner surface 130 of the centralizer 50 to block rotation of the centralizer 50 about the casing or liner 12.

Figure 9:
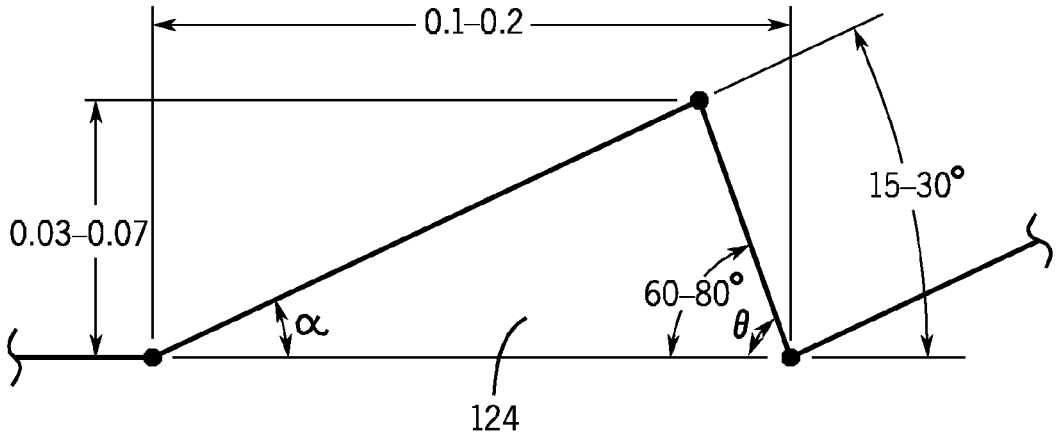
FIG. 9 depicts schematically an example of a tooth of a wedge segment, in accordance with aspects of the present disclosure.

As discussed above, the teeth 124 may be carburized teeth and may be suitably dimensioned so as to facilitate cutting into and/or gripping the casing or liner string 12 when the wedge segment 60 is in place. For example, turning to FIG. 9, in one implementation, each tooth 124 may be about 0.03 inches to about 0.07 inches in height (such as $1/16$th of an inch) and about 0.1 inches to about 0.2 inches in length. In one embodiment, an angle $\alpha$ associated with each tooth 124 may be about 15° to about 30° while an angle $\theta$ may be about 60° to about 80°. As will be appreciated the examples of measurements and angular ranges provided herein are not intended to be limiting and instead merely provided examples of suitable dimensions and/or angles. Other dimensions and/or angles may also be suitable and are encompassed by the present disclosure.

While the preceding discussion has generally related to the application of a centralizer 50 to a casing or liner 12 using wedge segments 60, it should be appreciated that this implementation has been provided by way of example only, and is not intended to limit the scope of the present disclosure. That is, the use of wedge segments 60 as disclosed herein may be similarly applied to attach other elements or structures to a tubular element. For example, wedge segments 60 as disclosed herein may be used to apply wear bands or other structures to a casing or liner string 12 or to any other suitable tubular element. With the foregoing discussion in mind, it should be appreciated that certain presently described embodiments allow engagement of a structure, such as a centralizer or wear band, to a tubular element, such as a casing or liner string by the use of wedge rings as discussed herein.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A wedge segment, comprising:

an arcuate body having a tapered profile sized to engage with a tubular element;

an inner surface of the arcuate body comprising a first surface treatment configured to grip an outer surface of the tubular element; and an outer surface of the arcuate body comprising a second surface treatment configured to grip an inner surface of a centralizer disposed about the tubular element and comprising a key configured to engage with a keyhole formed in the inner surface of the centralizer, wherein the key extends along a length of the wedge segment.

2. The wedge segment of claim 1, wherein the arcuate body is approximately 6 inches long.

3. The wedge segment of claim 1, wherein the tubular element comprises a casing, a liner string, or a drill pipe.

4. The wedge segment of claim 1, wherein the first surface treatment comprises a plurality of teeth.

5. The wedge segment of claim 4, wherein the plurality of teeth comprises carburized teeth.

6. The wedge segment of claim 1, wherein the second surface treatment comprises a first plurality of teeth configured to engage with a second plurality of teeth formed in the inner surface of the centralizer.

7. An assembly, comprising:

a casing or liner string;

a centralizer disposed around a circumference of the casing or liner string; and a first wedge segment positioned between an inner surface of a first end of the centralizer and an outer surface of the casing or liner string, wherein the first wedge segment is frictionally engaged with the inner surface of the first end of the centralizer and the outer surface of the casing or liner string, and wherein the first wedge segment comprises a key configured to engage with a keyhole of the inner surface of the first end of the centralizer to block rotation of the centralizer about the casing or liner string.

8. The assembly of claim 7, comprising a second wedge segment positioned between the inner surface of the first end of the centralizer and the outer surface of the casing or liner string.

9. The assembly of claim 7, wherein the first wedge segment comprises a first surface treatment configured to create a first frictional engagement with the outer surface of the casing or liner string.

10. The assembly of claim 9, wherein the first wedge segment comprises a second surface treatment configured to create a second frictional engagement with the inner surface of the first end of the centralizer.

11. The assembly of claim 10, wherein the second surface treatment comprises a first plurality of teeth configured to engage with a second plurality of teeth formed in the inner surface of the first end of the centralizer.

12. The assembly of claim 7, wherein the wedge segment comprises a tapered profile such that when positioned between the inner surface of the first end of the centralizer and the outer surface of the casing or liner string, a radially inward pressure is exerted on the outer surface of the casing or liner string.

13. A method for coupling a centralizer to a tubular member, comprising:

disposing the centralizer about the tubular member;

creating a first frictional engagement between an inner surface of a first wedge segment and the tubular member, wherein the inner surface has a first surface treatment;

creating a second frictional engagement between an outer surface of the first wedge segment and the centralizer, wherein the outer surface has a second surface treatment; and engaging a key formed in the outer surface of the first wedge segment with a keyhole formed in an inner surface of the centralizer to block rotation of the centralizer about the tubular member.

14. The method of claim 13, comprising creating a third frictional engagement between a second wedge segment and the tubular member, and creating a fourth frictional engagement between the second wedge segment and the centralizer.

15. The method of claim 13, comprising disposing an annular plate about the tubular member such that the annular plate is abutting the first wedge segment and forcing the first wedge segment between the centralizer and the tubular member with the annular plate by translating the annular plate with a hydraulic ram.

16. The method of claim 13, wherein creating the first frictional engagement between the first wedge segment and the tubular member comprises creating a radially inward force on the tubular member by the first wedge segment using a tapered profile of the first wedge segment.

17. The method of claim 13, wherein creating the second frictional engagement between the first wedge segment and the centralizer comprises engaging a first plurality of teeth of the second surface treatment of the outer surface of the first wedge segment with a second plurality of teeth formed in an inner surface of the centralizer.

* * * * *